US006202325B1

(12) United States Patent
Kim

(10) Patent No.: US 6,202,325 B1
(45) Date of Patent: Mar. 20, 2001

(54) FOOTGEAR SOLE AND SANDAL

(76) Inventor: Sangcheol Kim, 3-2-1 Higashi-Kanamachi, Katsushiki-ku, Tokyo (JP)

( * ) Notice: Subject to any disclaimer, the term of this patent is extended or adjusted under 35 U.S.C. 154(b) by 0 days.

(21) Appl. No.: 09/358,692

(22) Filed: Jul. 21, 1999

Related U.S. Application Data

(63) Continuation-in-part of application No. 09/178,632, filed on Oct. 26, 1998, now abandoned.

(30) Foreign Application Priority Data

Oct. 27, 1997 (JP) ..... 9-294187
Oct. 22, 1998 (JP) ..... 10-300878
Apr. 19, 1999 (JP) ..... 11-111294

(51) Int. Cl.[7] ..... A43B 3/12; A43B 13/04; A43B 23/28; A43C 15/00

(52) U.S. Cl. ..... 36/11.5; 36/32 R; 36/59 R; 36/59 C; D2/953; D2/959

(58) Field of Search ..... 36/59 R, 59 C, 36/25 R, 30 R, 32 R, 11.5, 33; D2/951, 953, 957, 958, 959, 960

(56) References Cited

U.S. PATENT DOCUMENTS

| | | | | |
|---|---|---|---|---|
| D. 86,527 | * | 3/1932 | Klein | D2/959 |
| D. 115,636 | * | 7/1939 | Sperry | D2/959 |
| D. 189,839 | | 3/1961 | Nakashima . | |
| D. 401,395 | * | 11/1998 | Clarke | D2/953 |
| D. 414,317 | * | 9/1999 | Lubart | D2/951 |
| D. 421,832 | * | 3/2000 | Loveder | D2/957 |
| D. 424,793 | * | 5/2000 | Lubart | D2/957 |
| 1,167,019 | * | 1/1916 | Reed | 36/11.5 |
| 1,867,679 | * | 7/1932 | Riehel et al. | 36/11.5 |
| 2,057,072 | * | 10/1936 | Sullivan | 36/11.5 |
| 2,092,533 | * | 9/1937 | Hyde | 36/11.5 |
| 2,096,500 | * | 10/1937 | McCahan et al. | 36/11.5 |
| 2,124,986 | | 7/1938 | Pipes . | |
| 2,160,377 | * | 5/1939 | Bain | 36/11.5 |
| 2,928,192 | | 3/1960 | Green . | |
| 2,932,097 | * | 4/1960 | George | 36/11.5 |
| 3,000,421 | | 9/1961 | Hack et al. . | |
| 3,662,478 | | 5/1972 | Schwab . | |
| 3,875,689 | | 4/1975 | Frau Tomas . | |
| 4,172,330 | * | 10/1979 | Kao | 36/11.5 |
| 4,525,940 | * | 7/1985 | Mochizuki | 36/11.5 |
| 4,843,736 | * | 7/1989 | Courian | 36/11.5 |

* cited by examiner

*Primary Examiner*—Paul T. Sewell
*Assistant Examiner*—Anthony Stashick
(74) *Attorney, Agent, or Firm*—Finnegan, Henderson, Farabow, Garrett & Dunner, L.L.P.

(57) ABSTRACT

A footgear sole is formed of a material with resiliency and has a uniform thickness over the entire area thereof inclusive of a heel portion. An incision is formed in the ground plane of the sole along a straight line extending via one point present at a nearly central point of the ground plane, in a longitudinal direction of the footgear. Further, a plurality of incisions are formed in the ground plane along segments defining a plurality of similar quadrilaterals each having two corners thereof placed on the straight line, in a manner being opposed to each other across the one point, and another two corners thereof placed on a second straight line present in an assumed plane including the ground plane and orthogonal to the first straight line via the one point, in a manner being opposed to each other across the one point. At walking, the sole can be easily deformed along the incisions, depending on force received from a foot of the wearer or the ground.

16 Claims, 7 Drawing Sheets

FOOTGEAR SOLE AND SANDAL

RELATED APPLICATION

This invention is a continuation-in-part application of Ser. No. 09/178,632, filed Oct. 26, 1998.

BACKGROUND OF THE INVENTION

1. Field of the Invention

This invention relates to an improvement of footgear, and more particularly to an improvement of the construction of a footgear sole.

2. Description of the Prior Art

Conventionally, there have been proposed various kinds of footgear in an attempt to facilitate well-balanced walking, which, however, have been unsuccessful. It is essential to perform right or proper walking in order to prevent diseases and to maintain good health of human beings. The right and well-balanced walking of human beings stems from assuming a standing position. In other words, to vertically stand on a horizontal plane against the gravity is the essential factor in right walking. To this end, the bottoms of feet of a human being, which function as a base of the standing position, must be placed on the horizontal plane. The right and well-balanced walking causes mixer movement to the pelvis of the human being in a suitable manner, and further the walking transfers tension and relaxation to muscles of legs. The thus transferred tension and relaxation cause a pumping function of blood vessels at lower portions of the muscles to accelerate blood circulation, which leads to good health of the human being. Ideally, to walk barefoot is the best manner of walking. Therefore, in society where human beings essentially wear footgear, the range and function of barefoot movement should be protected to a possible furthest extent. Ideally, the footgear should be formed such that the bottom of the foot and the footgear move in one body during walking.

Conventional footgear, however, has impeded the range and function of the barefoot movement. In the conventional footgear proposed, for example, by U.S. Pat. No. 2,124,986, 2,928,192, 3,662,478, and, U.S. Pat. No. D 189,839, the sole has a raised heel portion. For example, a footgear sole disclosed by U.S. Pat. No. 2,928,192 includes a member having a uniform thickness, however, the sole is provided with an additional member at a heel portion, whereby the entire thickness thereof is not uniform. Similarly, a footgear sole proposed by U.S. Pat. No. 2,124,986 does not have a uniform thickness over the entire area thereof.

Because of the reasons mentioned above, it is difficult to obtain the essential factor in right walking, i.e. "to vertically stand on the horizontal plane against the gravity", by wearing any of the conventional footgear, and therefore right and well-balanced walking cannot be performed. In regard to this point, some of Japanese sandals have the construction with a uniform thickness. Conventional footgear having the uniform thickness, however, can provide only awkward style of walking and is liable to slip out of the foot of the wearer. It is not always correct that footgear having the uniform thickness can provide right walking. To cope with this inconvenience, there may be conceived an idea that comfortable walking is obtained by wearing footgear which is formed of an extremely soft material and liable to be deformed depending on force applied thereto by the foot or by the ground. If the footgear is formed of the material mentioned above, however, unevenness of the ground directly affects the bottom of the foot, whereby the primary function of footgear, i.e. to protect the foot, is damaged. Further, such a soft material has a problem of poor durability.

On the other hand, there is known a footgear sole, for example, from U.S. Pat. No. 3,875,689, which has an almost uniform thickness over the entire area thereof, without raising a heel portion. However, the footgear sole of this type tapers in thickness at a tip portion thereof in an attempt to provide comfortable walking, and therefore the entire sole is not strictly uniform in thickness. As a result, when the wearer of this footgear stands on the horizontal plane in order to assume the essential position for the right walking, he can feel unstable.

In addition, incisions or grooves formed in the conventional footgear sole are provided with a view of a slip stopper, and therefore they do not function to deform the sole as appropriate during walking. For example, the footgear sole disclosed by U.S. Pat. No. 2,124,986 has formed therein slits which exclusively functions as a slip stopper. Therefore, the construction of the slit is not liable to change the sole into a shape suitable for walking.

SUMMARY OF THE INVENTION

It is therefore an object of the invention to provide footgear which allows a human being to perform right or proper walking to a possible furthest extent.

To attain the above objects, the present invention provides a sole of footgear having the following construction: First, the sole has a uniform thickness over an entire area thereof inclusive of a heel portion, and the sole is formed of a material with resiliency. Then, incisions or grooves are formed in the ground plane of the sole. Specifically, an incision or a groove is arranged along a first straight line extending via one point present in an area in the ground plane, in a longitudinal direction of the footgear, the area corresponding to an arch of a foot of a wearer. Further, a plurality of incisions or grooves are arranged along segments defining a plurality of similar quadrilaterals each having two corners thereof placed on the first straight line, in a manner being opposed to each other across the one point, and another two corners thereof placed on a second straight line present in an assumed plane including the ground plane and orthogonal to the first straight line via the one point, in a manner being opposed to each other across the one point.

Alternatively, according to another aspect of the invention, incisions or grooves are arranged in the following manner: That is, an incision or a groove is arranged along a first straight line extending via one point in an area in the ground plane, in a longitudinal direction of the footgear, the area corresponding to an arch of a foot of a wearer, and a plurality of incisions or grooves are arranged along a plurality of vees each having a point on the first straight line as an inflection point thereof and allowing both ends thereof to extend to a periphery of the ground plane, in a manner opening toward a tip portion of the sole.

The above and other objects, features and advantages of the invention will be more apparent from the following detailed description taken in conjunction with the accompanying drawings.

DETAILED DESCRIPTION

The invention will now be described in detail with reference to the drawings showing embodiments thereof. In the embodiments, the description will be made of a sandal as an example of footgear.

Figure 1:
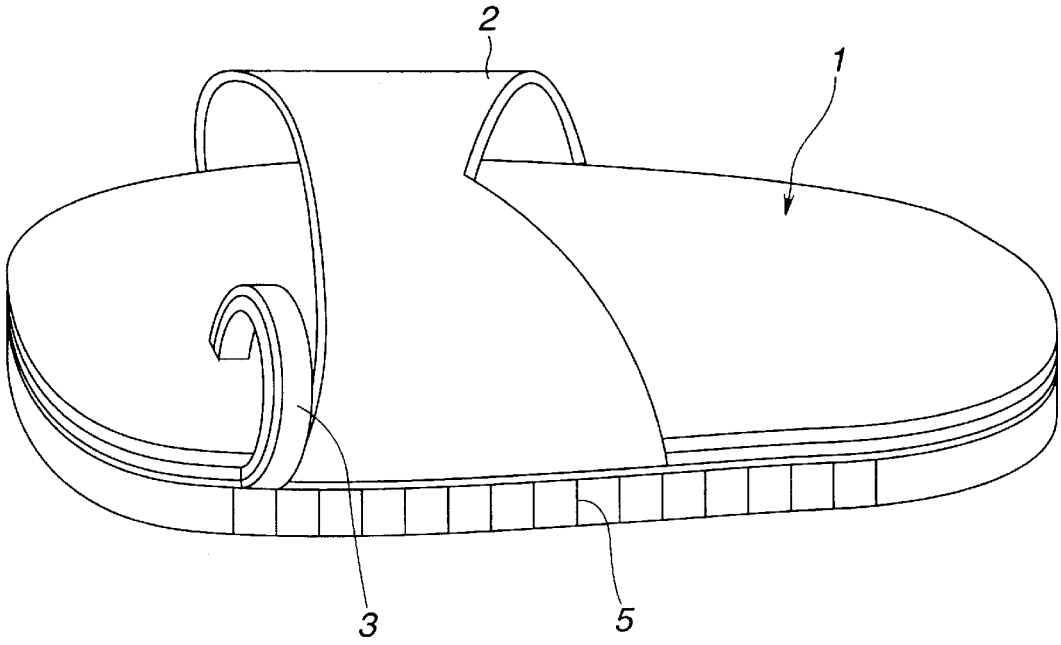
FIG. 1 is a perspective view showing the appearance of a sandal according to a first embodiment of the invention.
Figure 2:
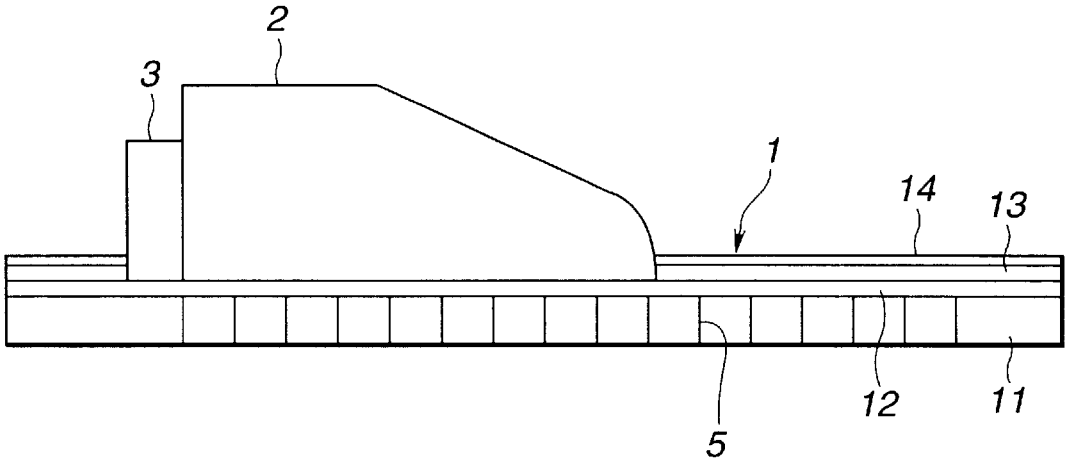
FIG. 2 is a side view of the sandal shown in FIG. 1.
Figure 3:
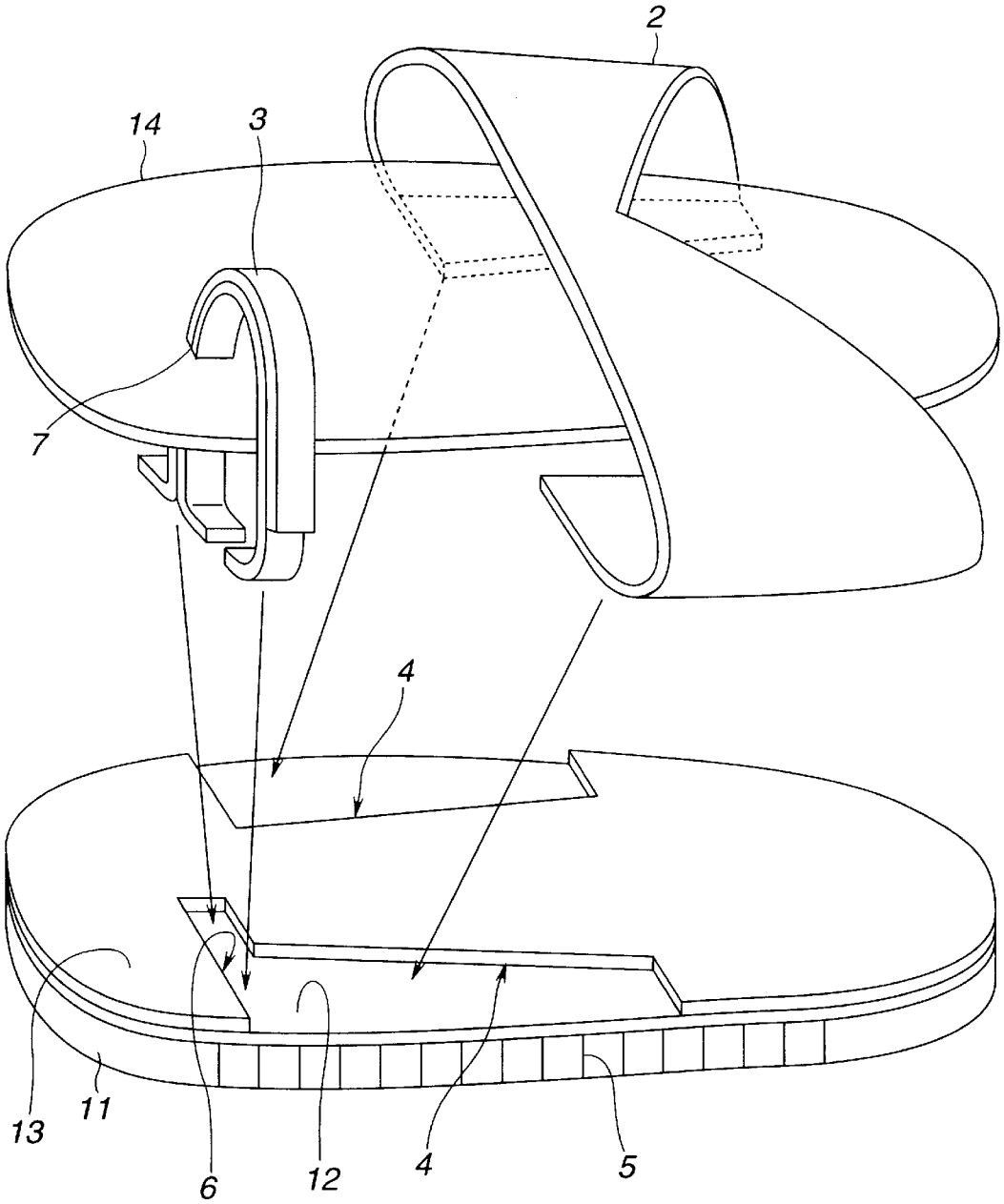
FIG. 3 is a perspective assembly view of the sandal shown in FIG. 1.

Referring first to FIG. 1, there is schematically illustrated the appearance of a sandal according to a first embodiment of the invention. FIG. 2 is a side view of the sandal and FIG. 3 is a perspective assembly view of the same. As shown in FIG. 1, the sandal is comprised of a sole 1, a main band 2, and a big-toe band 3. The main band 2 functions to hold an instep of a foot of the wearer, while the big-toe band 3 functions to hold a big toe of the foot.

As shown in FIGS. 2 and 3, the sole 1 has a four-layered structure which is comprised of a first layer 11 which is the undermost layer of the sole 1 and formed of a material with resiliency, such as sponge or rubber, a second layer 12 laminated on an upper surface of the first layer 11 and formed of a flexible and durable material, a third layer 13 laminated on an upper surface of the second layer 12 and formed of a flexible material such as artificial leather, and a fourth layer 14 laminated on an upper surface of the third layer 13 and formed of a flexible material such as artificial leather. Each of the layers has a uniform thickness, and accordingly the entire sole 1 of the sandal exhibits the resiliency as a whole and has a uniform thickness over the entire area thereof.

The third layer 13 includes recesses or indentations 4 at both end portions thereof with respect to a width direction. The main band 2 is folded at both ends thereof, so that the both ends are bonded on the upper surface of the second layer 12, at two portions exposed from the recesses 4. The main band 2 is formed of the same material as that of the third layer 13 and the same in thickness as the third layer 13. Therefore, when the main band 2 is secured to the second layer 12, the recesses 4 of the third layer 13 are filled with a member having the same thickness and of the same material. As a result, attachment of the main band 2 to the second layer 12 does not impair the uniformity in thickness of the sole 1 over the entire area.

In the same manner, the big-toe band 3 is attached to the second layer 12. The big-toe band 3 is composed of a two-layered strip each being formed of the same material as that of the third layer 13 and having the same thickness as that of the third layer 13, while a portion to be bonded on the second layer 12 assumes a single layer. The third layer 13 includes another recess 6 adjacent to one of the recesses 4, and the single-layered portion of the big-toe band 3 is bonded on the upper surface of the second layer 12.

The fourth layer 14 serving as a cover of the entire sole 1 has an aperture 7 formed therein, into which is inserted the big-toe band 3. The fourth layer 14 is laminated on the third layer 13 so as to cover the bonded portions of the main band 2 and the big-toe band 3.

Figure 4:
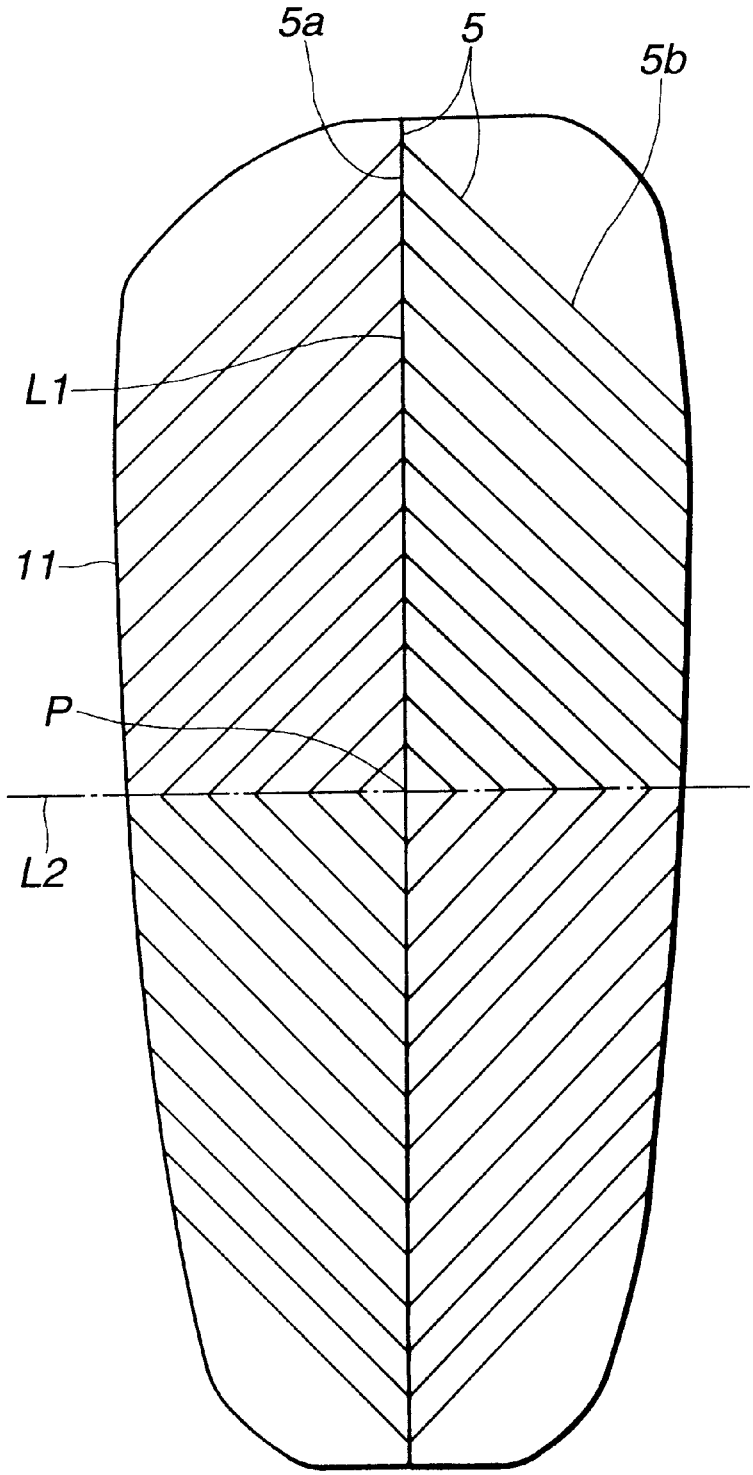
FIG. 4 is a bottom plan view of a sole of the sandal shown in FIG. 1.

The first layer 11 has a ground plane which has formed therein a plurality of incisions 5, as shown in FIG. 4, consisting of an incision 5*a* and incisions 5*b*. The incision 5*a* is formed in the ground plane of the first layer 11 along a straight line L1 extending via a point P in the longitudinal direction of the sole 1. The point P nearly corresponds to a central point of the ground plane, which is arranged in an area corresponding to the arch of the foot. The incisions 5*b* are formed in the following manner: First, a quadrilateral is determined by two points as corners thereof being opposed to each other across the point P on the line L1, and another two points as another corners thereof being opposed to each other across the point P on a straight line L2 in an assumed plane including the ground plane. The straight line L2 passes on the point P and is orthogonal to the line L1. Then, a plurality of similar quadrilaterals are depicted on the assumed plane. The incisions 5*b* are formed along segments defining the thus depicted similar quadrilaterals.

An angle that each of the incisions 5*b* forms with respect to the straight line L1 is 45 degrees on the side of an acute angle. The incisions 5*a* and 5*b* have a depth that reaches a lower surface of the second layer 12. In addition, the incisions 5*a* and 5*b* are each formed at right angles or at almost right angles with respect to the ground plane of the first layer 11.

Figure 5:
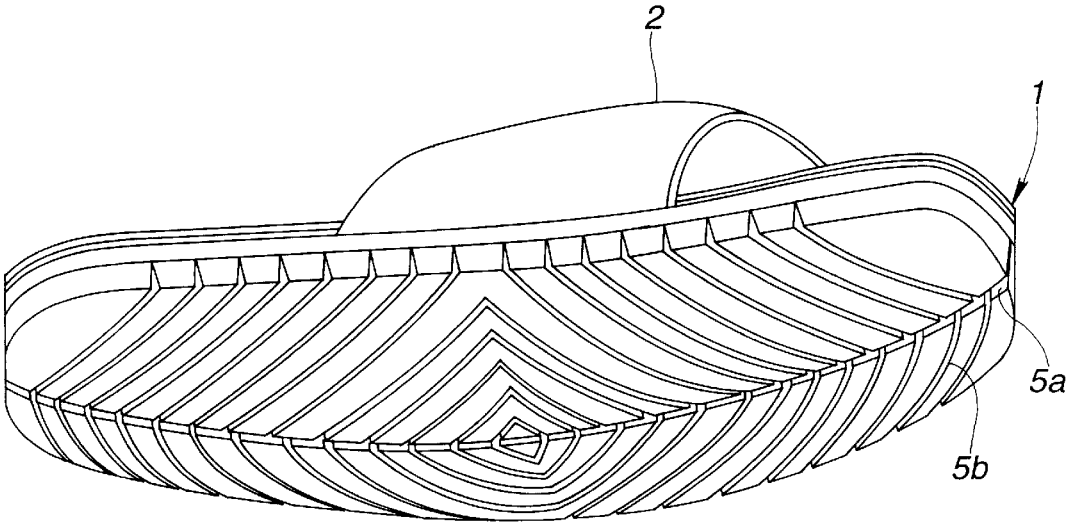
FIG. 5 is a perspective view of the sandal sole shown in FIG. 1, in which the sole is deformed.

The sandal according to the invention is constructed as above, and works in the following manner: Due to the formation of the incision 5*a*, the sole 1 is liable to be warped toward the foot in the width direction. On the other hand, due to the formation of the incisions 5*b*, the sole 1 is liable to be warped toward the foot, along the above described segments defining the similar quadrilaterals. FIG. 5 shows an example of the appearance of the sandal assumed when the sole 1 is deformed. In actual walking, force applied to the sole 1 by the foot, the ground, and the bands 2 and 3 are so complicated that each section of the sole is not simultaneously and evenly deformed. Yet the sole 1 is basically warped toward the foot away from the point P in a manner wrapping the foot. As a result, the sole 1 can be easily deformed depending on a state of the foot during walking.

For instance, when the foot is put on the ground during walking, a periphery of a heel portion of the sole 1 first comes into contact with the earth. On this occasion, the heel portion is warped toward the foot depending on the shape of a heel of the wearer, and therefore the wearer does not receive excessive force by way of the sole 1, to thereby perform stepping as if the wearer walked barefoot.

A bottom of the foot moves in the following manner; First the heel is placed, and then a portion of the bottom to be placed is progressively advanced toward a toe of the foot. Thereafter, the heel is raised, and finally the tip is separated from the ground. During this movement, the sole 1 is easily deformed depending on the state of the bottom of the foot, and therefore the sole 1 rarely impedes the movement of the foot.

Further, in the sole 1, the incisions 5*b* are arranged so as to form a plurality of vees opening from the tip portion to the central portion or from the heel portion to the same. Therefore, when the foot is put on the ground, friction works between the sole 1 and the ground against a forward direction by the V-shaped incisions of the heel portion. When the sole 1 is separated from the ground, the tip portion gives a backward kick at the ground, and therefore friction is generated by the V-shaped incisions of the tip portion, which prevents the wearer from slipping during walking and hence brings about great safety to the wearer.

According to the embodiment, the angle that each of the incisions 5*b* forms with respect to the straight line L1 is set to 45 degrees. At this angle, the sole 1 is deformed in an optimal manner depending on the state of the foot during walking, but this is not limited. Alternatively, almost the same effect can be exhibited at angles in the range between 30 degrees to 60 degrees. The interval between the incisions 5*b* is preferably set to approximately 1 cm.

The point P on the ground plane of the sandal is preferably set to the almost central point thereof, but this is not limited. Alternatively, it may be set to any point in the area corresponding to the arch of the foot.

The layers of the sandal according to the embodiment are formed of different materials from each other. For example, the uppermost fourth layer 14 may be formed of a material which is comfortable to wear, while the undermost first layer 11 may be formed of a material which is resistant to friction between the ground and the undermost layer.

Further, the first layer 11 has the incisions 5 formed therein, and therefore even if the layer 11 is formed of a relatively hard material, the sole 1 can be easily changed into a shape depending on the state of the foot bottom. As a result, the sole 1 can be tough and durable, which does not damage the essential function of footgear, i.e. to protect the foot from the ground. Still further, an upper surface of the undermost layer of the sole 1 is always in parallel with the ground surface, and therefore the wearer can have a feeling to a further extent that he walks barefoot on the ground.

According to the sandal of the embodiment, the entire sole 1 inclusive of the heel portion has the uniform thickness, and further the ground plane thereof has formed therein the incisions 5 in a unique manner. This special formation of the sandal can function to protect right walking to a possible furthest extent.

Figure 6:
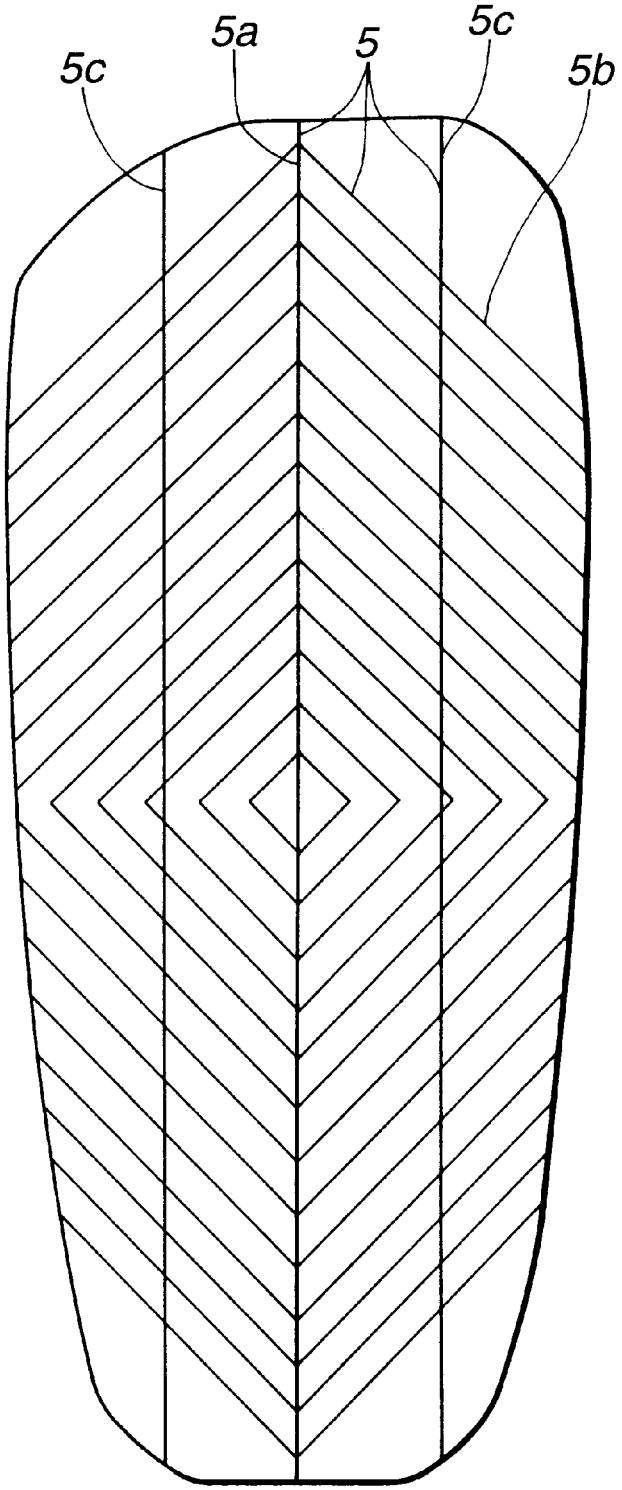
FIG. 6 is a bottom plan view showing a sole of the sandal, according to a second embodiment of the invention.

FIG. 6 shows a sandal sole according to a second embodiment of the invention. The sole 1 in the present embodiment is different from the first embodiment in that another two straight lines are formed in the ground plane of the sole 1. Except for this, the sole in the present embodiment is the same in construction and arrangement as in the first embodiment, description thereof being omitted. As is apparent from FIG. 6, the two linear incisions 5*c* are arranged in parallel with the incision 5*a*, and extend almost along central lines of right and left halves of the ground plane, respectively. The thus formed sole 1 is more liable to be warped in the width direction, which alleviates an undesirable effect exerted on the foot by the sole during walking, to a further extent.

As the number of the linear incisions is larger, the sole is more liable to be warped, leading to better fitting of the sandal to the shape of the foot. However, the increased incisions can bring down increased brittleness to the sole formed of some materials. Therefore, the number of the linear incisions should be determined depending on the material of the sole and the intended purpose of footgear.

Figure 7:
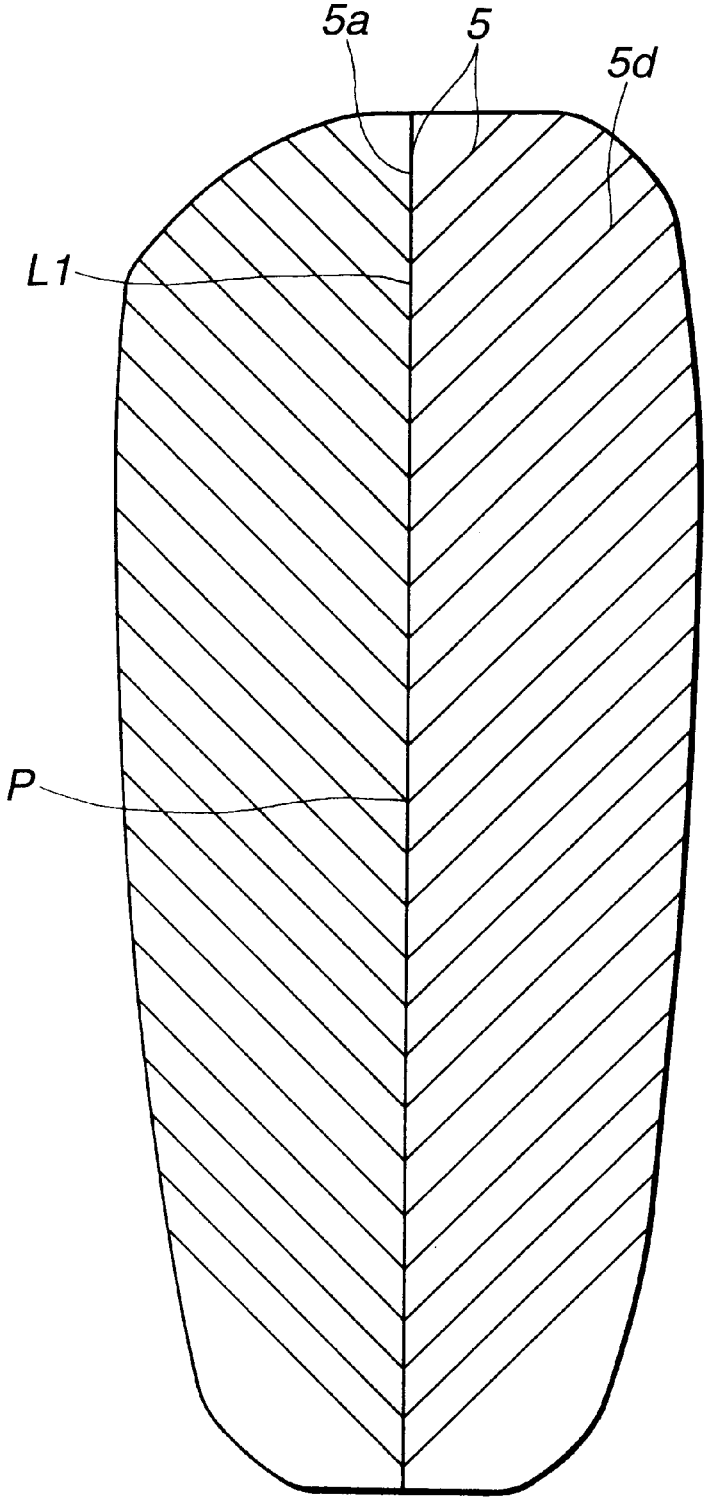
FIG. 7 is a bottom plan view showing a sole of the sandal, according to a third embodiment of the invention.

Next, description will be made of a third embodiment of the invention. The ground plane of the sandal according to the present embodiment is different from the first embodiment in that incisions in the ground plane are formed as shown in FIG. 7. Except for this, the sole in the present embodiment is the same in construction and arrangement as in the first embodiment, description thereof being omitted.

As shown in FIG. 7, the incisions 5 consist of the incision 5*a* and a plurality of incisions 5*d*. The incision 5*a* is formed in the ground plane of the sole 1 almost along the straight line L extending via the point P in the longitudinal direction of the sole 1, similarly to the first embodiment. On the other hand, the incisions 5*d* linearly extend on both the sides of the incision 5*a* such that they each form, with the incision 5*a*, an acute angle opening toward the toe portion. The incisions 5*d* extend from a plurality of points on the incision 5*a* to the periphery of the undermost layer 11, respectively. The right and left incisions 5*d* pair with each other, and they are formed into a plurality of vees with the points on the incision 5*a* as inflection points, respectively.

As described hereinbefore, the wearer puts his foot on the ground from the heel to the toe, and therefore, according to the embodiment, the sandal sole is sufficiently deformed depending on the bottom of the foot that it does not impede the walking of the wearer.

The angle formed by the incisions 5*d* with respect to the incision 5*a* should be set to a value in the range from 30 to 60 degrees, and preferably it should be set to 45 degrees.

In the present embodiment, the ground plane of the sandal may further have a plurality of the linear incisions 5*c*, similarly to that in the second embodiment. Still further, the point P on the ground plane may be determined at any point in the area corresponding to the arch, similarly to the embodiments 1 and 2.

In the above described embodiments 1 to 3, the sole 1 is formed by four layers, but the number of the layers may be set to a desirable value as needed. For example, portions corresponding to the third layer 13, the fourth layer 14, and the bands 2 and 3 may be integrally formed of a single material, whereby the entire sandal has a three-layered structure. Further, if portions other than the first layer are integrally formed of a single material, the sole 1 has a two-layered structure. Alternatively, the entire sandal may be integrally formed of a single material. The material to form the sandal may be any one so far as it has resiliency. If the sole is formed by a smaller number of layers, the construction thereof can be simplified, which contributes to reduction in manufacturing cost. It is needless to say that component elements for engaging the foot, such as the bands 2 and 3, can be designed to have desired shapes in desired quantity, as needed.

In the above embodiments, the description has been made of the construction of the sandal by way of example, but a similar effect can be exhibited in a similar sole of footgear other than the sandal, such as Japanese sandals and shoes. In the shoe sole, however, a member to cover the entire sole from its tip portion to its toe portion is attached to the sole, and therefore it is desirable that the member is formed of a soft material.

In the above embodiments, the incisions are formed in the sole, which, however, may be incisions each having a clearance, that is, grooves. Further, the term"incision" means not only one formed by actually cutting a certain member, but also one molded by using a die, and further one obtained by arranging a plurality of members adjacent to each other to form the members into a shape of a single member with incisions.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A sole of footgear, including a heel portion and a ground plane, said sole being formed of a material with resiliency, and having a uniform thickness over an entire area thereof inclusive of said heel portion, comprising:

an incision or a groove formed in said ground plane and arranged along a first straight line extending via one point present in an area in said ground plane, in a longitudinal direction of said footgear, said area corresponding to an arch of a foot of a wearer; and a plurality of incisions or a plurality of grooves formed in said ground plane and arranged along segments defining a plurality of similar quadrilaterals each having two corners thereof placed on said first straight line, in a manner being opposed to each other across said one point, and another two corners thereof placed on a second straight line present in an assumed plane including said ground plane and orthogonal to said first straight line via said one point, in a manner being opposed to each other across said one point.

2. A sole of footgear as claimed in claim 1, wherein said one point in said area corresponding to said arch of said foot is nearly a central point of said ground plane.

3. A sole of footgear as claimed in claim 1, wherein said sole is formed by a plurality of layers including an undermost layer, said ground plane being formed by a lower surface of said undermost layer, said plurality of layers being formed of different materials.

4. A sole of footgear as claimed in claim 3, wherein said incisions or said grooves are formed such that a depth thereof is equal to a thickness of said undermost layer.

5. A sole of footgear as claimed in claim 1, wherein said sole is formed of a single uniform material.

6. A sandal including a sole as claimed in claim 1, and at least one band having ends thereof bonded on said sole;

wherein said sole is formed by a plurality of layers each having a uniform thickness and including an undermost layer, said at least one band being formed by a member having a thickness equal to said thickness of a predetermined layer of said plurality of layers other than said undermost layer, said predetermined layer having recesses; and wherein said at least one band has said ends thereof directly secured to a surface of a layer immediately lower than said predetermined layer, at a location being exposed from said recesses of said predetermined layer.

7. A sandal as claimed in claim 6, wherein said at least one band includes a main band for holding an instep of a foot of a wearer, and a big-toe band for holding a big toe of said foot.

8. A sandal as claimed in claim 6, wherein said plurality of layers include an uppermost layer, said predetermined layer being a layer immediately lower than said uppermost layer.

9. A sole of footgear, including a heel portion and a ground plane, said sole being formed of a material with resiliency, and having a uniform thickness over an entire area thereof inclusive of said heel portion, comprising:

an incision or a groove formed in said ground plane and arranged along a first straight line extending via one point present in an area in said ground plane, in a longitudinal direction of said footgear, said area corresponding to an arch of a foot of a wearer;

a plurality of incisions or a plurality of grooves formed in said ground plane and arranged along segments defining a plurality of similar quadrilaterals each having two corners thereof placed on said first straight line, in a manner being opposed to each other across said one point, and another two corners thereof placed on a second straight line present in an assumed plane including said ground plane and orthogonal to said first straight line via said one point, in a manner being opposed to each other across said one point; and at least one incision or at least one groove formed in said ground plane and arranged along at least one straight line other than said first straight line extending in parallel with the same.

10. A sole of footgear as claimed in claim 9, wherein said one point in said area corresponding to said arch of said foot is nearly a central point of said ground plane.

11. A sole of footgear as claimed in claim 9, wherein said sole is formed by a plurality of layers including an undermost layer, said ground plane being formed by a lower surface of said undermost layer, said plurality of layers being formed of different materials.

12. A sole of footgear as claimed in claim 11, wherein said incisions or said grooves are formed such that a depth thereof is equal to a thickness of said undermost layer.

13. A sole of footgear as claimed in claim 9, wherein said sole is formed of a single uniform material.

14. A sandal including a sole as claimed in claim 9, and at least one band having ends thereof bonded on said sole;

wherein said sole is formed by a plurality of layers each having a uniform thickness and including an undermost layer, said at least one band being formed by a member having a thickness equal to said thickness of a predetermined layer of said plurality of layers other than said undermost layer, said predetermined layer having recesses; and wherein said at least one band has said ends thereof directly secured to a surface of a layer immediately lower than said predetermined layer, at a location being exposed from said recesses of said predetermined layer.

15. A sandal as claimed in claim 14, wherein said at least one band includes a main band for holding an instep of a foot of a wearer, and a big-toe band for holding a big toe of said foot.

16. A sandal as claimed in claim 14, wherein said plurality of layers include an uppermost layer, said predetermined layer being a layer immediately lower than said uppermost layer.

* * * * *

UNITED STATES PATENT AND TRADEMARK OFFICE

CERTIFICATE OF CORRECTION

PATENT NO. : 6,202,325 B1
DATED : March 20, 2001
INVENTOR(S) : Kim

It is certified that error appears in the above-identified patent and that said Letters Patent is hereby corrected as shown below:

Title page,
Item [76], delete inventor's address and insert therefor -- 35-15, Higashi-kanamachi 1-chome, Katsushika-ku, Tokyo Japan. --

Signed and Sealed this

Twenty-seventh Day of August, 2002

*Attest:*

*Attesting Officer*

JAMES E. ROGAN
*Director of the United States Patent and Trademark Office*